US005575214A

United States Patent [19]

Braunstein et al.

[11] Patent Number: 5,575,214

[45] Date of Patent: Nov. 19, 1996

[54] APPARATUS FOR PRINTING ANY DOCUMENTS AND MAKING THEM UNFALSIFIABLE

[75] Inventors: Jean-Pierre Braunstein, 5, Rue des Grés, Boissise le Roy, France, 77310; Christian Bonnard, 66, Chemin du Milieu des Hauts Picards, Marly le Roi, France, 78160; Didier Ache, 1, Avenue d'Aligre, Le Pecq, France, 78230; Florence Duval, Yerres, France

[73] Assignees: Jean-Pierre Braunstein, Boissise le Roy; Christian Bonnard, Marly le Roi; Didier Ache, Le Pecq; Sesame, Paris, all of France

[21] Appl. No.: 403,162

[22] Filed: Mar. 13, 1995

[30] Foreign Application Priority Data

Mar. 15, 1994 [FR] France ..... 94 03001

[51] Int. Cl.[6] ..... B41F 31/00

[52] U.S. Cl. ..... 101/494; 101/487; 283/57

[58] Field of Search ..... 101/494, 424.1, 101/487, 488; 283/58, 59, 57, 91, 95, 901

[56] References Cited

U.S. PATENT DOCUMENTS

| | | | |
|---|---|---|---|
| 1,615,566 | 1/1927 | Brewer | 283/901 |
| 1,727,912 | 9/1929 | Snyder | 283/59 |
| 3,677,887 | 7/1972 | Rowsam et al. | 162/140 |
| 4,390,369 | 6/1983 | Merritt et al. | 106/31 |
| 4,484,984 | 11/1984 | Merritt et al. | 106/31 |
| 4,809,608 | 3/1989 | Wolnick et al. | 101/487 |
| 5,033,773 | 7/1991 | Brunea et al. | 283/95 |
| 5,329,295 | 7/1994 | Medin et al. | 101/488 |
| 5,427,415 | 6/1995 | Chang | 283/67 |

FOREIGN PATENT DOCUMENTS

| | | | |
|---|---|---|---|
| 0041024 | 12/1981 | European Pat. Off. | 283/95 |
| 0284215 | 9/1988 | European Pat. Off. . | |
| 0292094 | 11/1988 | European Pat. Off. . | |
| 0568172 | 11/1993 | European Pat. Off. . | |
| 0136262 | 8/1984 | Japan | 101/424.1 |
| 90/05893 | 11/1988 | WIPO . | |

*Primary Examiner*—Edgar S. Burr
*Assistant Examiner*—Anthony H. Nguyen
*Attorney, Agent, or Firm*—Pennie & Edmonds

[57] ABSTRACT

An apparatus for printing any documents and making them unfalsifiable and comprising a casing fitted on the body of a printer at its part receiving the discharged and printed documents and which contains means for heating one side of the printed document for the impregnation and the transfer of the printing ink throughout the thickness of the document so as to make appear on the other side thereof an exact replica with inverted writing of the printings previously made on the document such as a bank document, cheque letter or transfer order.

16 Claims, 3 Drawing Sheets

APPARATUS FOR PRINTING ANY DOCUMENTS AND MAKING THEM UNFALSIFIABLE

The present invention relates essentially to an improved apparatus for carrying out the printing of any documents whatsoever and for making them unfalsifiable.

It is known nowadays that the falsification or forgery of document such for example as cheque letters, transfer orders and banking documents in general give rise to serious problems. Such a forgery or faking may be made relatively easily by erasure of the documents or by dilutions of adapted chemical products so that finally the forged document has the appearance of an authentic document.

It is therefore appropriate to provide an apparatus which remedies such inconveniences and this in such a manner that if a falsification is attempted, the document will be necessarily destroyed or cut up.

The present invention reaches this goal by providing an improved printing apparatus capable of producing any printed documents whatsoever the forgery or faking of which is made practically impossible unless materially spoiling or damaging them so that the said documents be no longer acceptable visually.

For that purpose the object of the invention is to provide an apparatus for performing the printing of any documents whatsoever and for making them unfalsifiable, of the type comprising a body in which a document to be printed is carried along by suitable means for passing past a system for printing with ink jets for instance whereafter the printed document is discharged from the apparatus, characterized by a casing adaptable onto the body of the apparatus at the level of its portion receiving the discharged and printed documents, the said casing containing heating means adapted to heat one of the faces of the printed document to permit the impregnation and the transfer of the ink throughout the thickness of the document in order to make appear on the other face thereof a substantially exact replica with inverted writing of the printings previously performed on the said document.

This apparatus is further characterized in that the aforesaid casing is at least in part fitted into a receptacle for the printed documents, which receptacle is formed in the top wall of the body of the apparatus and leaves between it and the said casing a slot for the ejection of the documents after heating.

The aforesaid heating means are constituted by one or several halogen tubes capable of heating the documents owing to an opening formed in the casing and located plumb with the aforesaid receptacle.

According to another characterizing feature of this apparatus the casing comprises a first photodetector for sensing a printed document entering the aforesaid receptacle underneath the said casing and for controlling rollers or the like carrying the said document along in the casing.

According to still another characterizing feature of the apparatus according to this invention, the casing comprises a second photodetector which operates the stop of the aforesaid rollers and the lighting or switching on of the halogen tubes when the document is in an adequate heating position within the casing.

One should further specify here that the casing is provided with a cooling fan and with a connection to the mains provided in lateral extensions of the casing bearing upon the body of the apparatus.

This apparatus is further characterized in that the system for ink jet printing consists of a tank for natural or synthetic-based solid ink with which is associated a heating head to liquefy the ink and to throw in onto the document to be printed.

The documents to be printed by means of this apparatus could be particularly sensitive documents such for example as cheque letters, transfer orders or banking documents in general.

The invention will be understood and further objects, characterizing features, details and advantages thereof will appear better as the following explanatory description proceeds with reference to the accompanying diagrammatic drawings given by way of non-limiting example only illustrating a presently preferred specific embodiment of the invention and in which.

Figure 1:
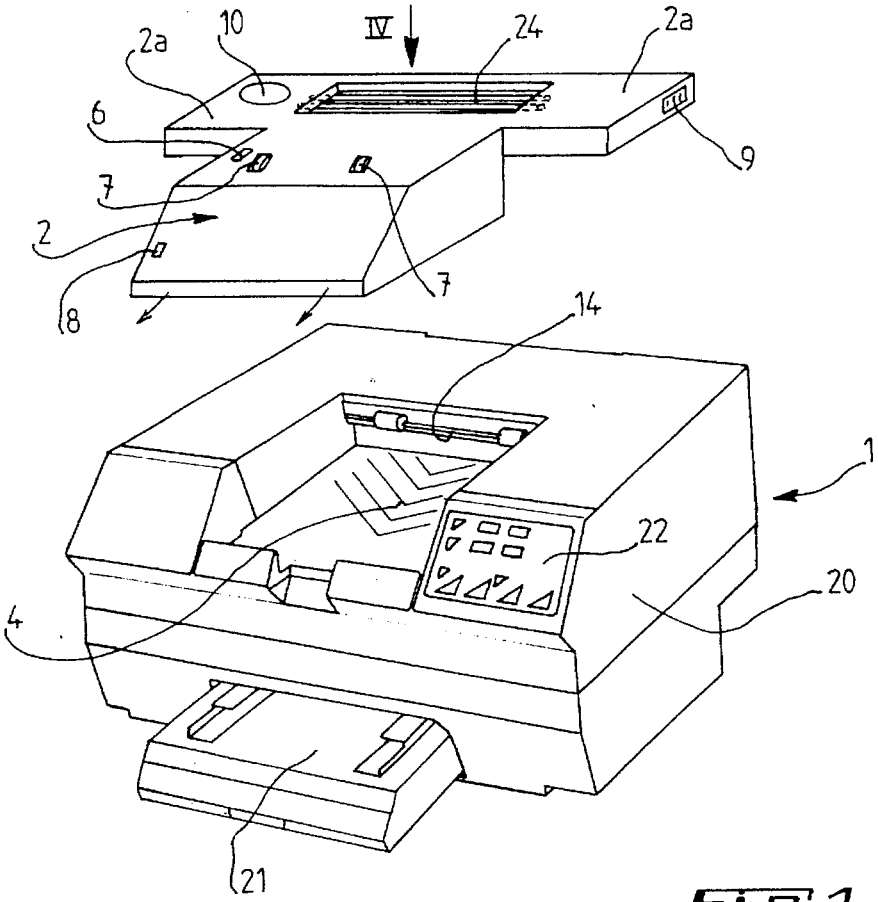
FIG. 1 is an exploded perspective view of an improved apparatus according to this invention.
Figure 2:
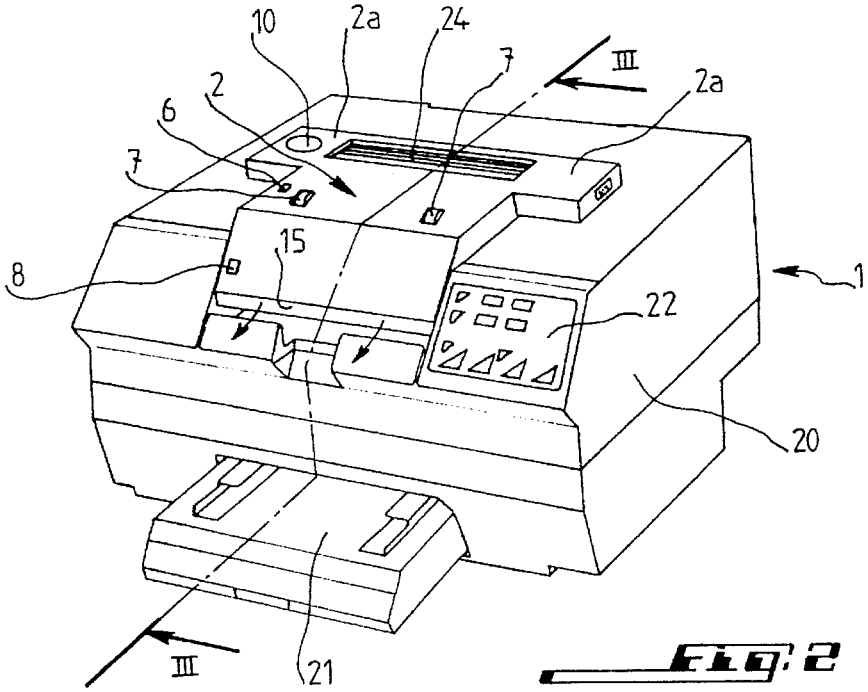
FIG. 2 is another perspective view of the apparatus illustrating its component parts in the assembled positions.
Figure 3:
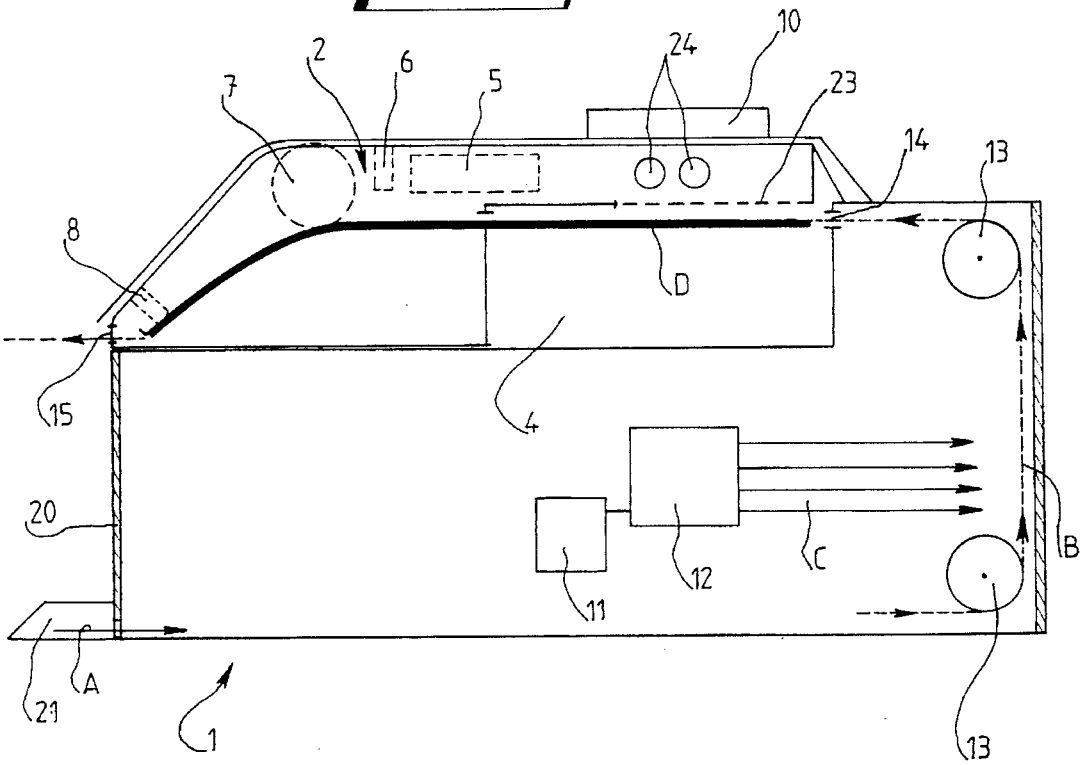
FIG. 3 is a diagrammatic view of the apparatus in section taken upon the line III—III of FIG. 2.
Figure 4:
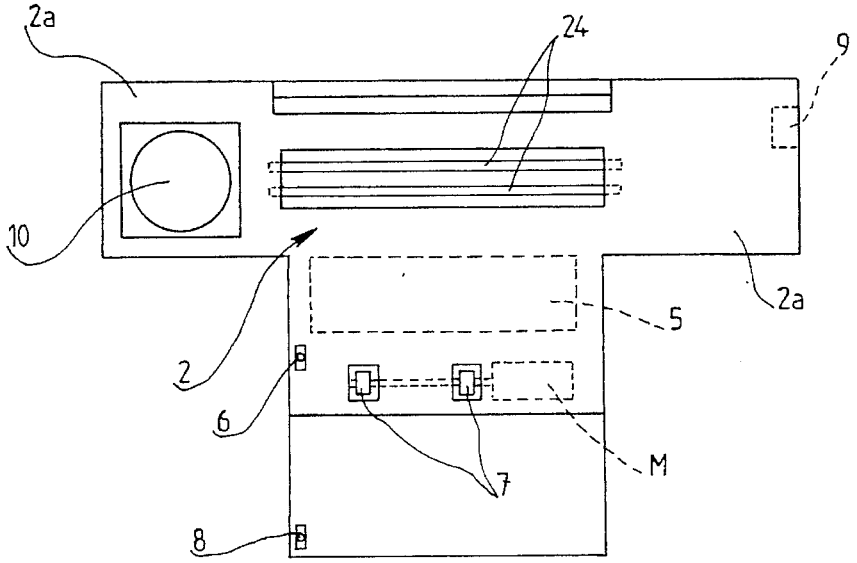
FIG. 4 is a plan and top view of the heating case seen in the direction of the arrow IV of FIG. 1.

Referring more particularly to FIGS. 1, 2 and 3 there is very diagrammatically seen an apparatus 1 for printing documents, of a type known per se and consisting essentially of a body 20 provided with a box 21 containing a supply of paper to be printed, of a receptacle 4 formed in the top wall of the body 20 to receive the printed documents moving out through a slot 14 and of a console or desk 22 for the control of the apparatus.

Inside of the body 20 of the apparatus 1 as very diagrammatically shown on FIG. 3 there is provided a system for the ink jet printing of the documents and a system for carrying along the documents from the supply box 21 to the outlet slot 14.

The printing system of a kind known per se consists of a tank 11 for solid ink with which is associated a heating head 12 permitting to liquefy the ink and to throw it upon the document to be printed.

The solid ink is a natural or synthetic wax-based product of a type known per se as disclosed in particular in the U.S. Pat. Nos. 4,390,369 and 4,484,948 which may be referred to. Thus such an ink could comprise the following elementsi-:behenic acid, carnauba wax, wax known under the name of "Acryloïd" and cyan-magenta-yellow-black coloring matters.

The system for driving the documents inside of the body 20 of the apparatus consists of rollers, cylinders or the like diagrammatically designated at 13, it being understood that the apparatus further comprises other means known per se and not shown such for example as means providing a lifting depression or partial vacuum allowing the documents to be ejected successively through the slot 14 for reaching and moving into the receptacle 4 receiving the printed documents.

In a general manner all the other means which the apparatus 1 which has just been described may comprise do not require additional explanations.

According to the invention onto the body 20 of the apparatus 1 is adapted a casing 2 forming a heating enclosure adapted to heat the printed documents moving out through the slot 14.

More specifically the casing 2 as is well seen on FIG. 2 is for the major part thereof fitted into the receptacle 4 and comprises extensions **2*a* provided with means 9, respectively, for the connection to an electrical supply such as the mains and a fan or blower 10 allowing the cooling of the heating means contained in the casing 2**.

These heating means according to the example shown consist of two halogen lamps or tubes 24.

As FIG. 3 clearly shows, an opening 23 is formed in the heating casing or enclosure 2 plumb with the halogen tube 24 to allow the radiation of the heat provided by the said lamps through the casing and over one of the faces or sides of the printed document located in the receptacle 4 of the apparatus 1.

At 5 has been diagrammatically shown an electronic unit for the feeding, the operation and the control of the travel of the documents in the heating casing or enclosure 2 from the slot 14.

The driving and carrying along of the documents in the casing 2 is provided by a plurality of rollers 7 well visible on FIGS. 1 to 4.

On these figures is also seen a first photodetector 6 allowing the sensing of a document moving out through the slot 14 and travelling to and into the receptacle 4 below the casing 2. This photodetector 6 would operate a motor M providing for the rotary drive of the rollers 7.

The heating casing or enclosure 2 further comprises at its front end fitted into the receptacle 4; a second photodetector 8 capable of operating the stop of the motor M when the document driven or carried along by the rollers 7 assumes an adequate heating position in the casing 2.

At 15 on FIGS. 2 and 3 is shown a slot formed between the lower part of the casing 2 and the receptacle 4, this slot permitting the ejection of the documents printed and heated by the apparatus. It should be pointed out that these documents may be collected or gathered in a box of suitable shape not shown.

Now for a better understanding of the invention, the operation of the apparatus which has just been described will be explained hereinafter.

As seen on FIG. 3, a document coming from the supply 21 is inserted into the apparatus 1 according to the arrow designated at A.

The document then follows the path of travel physically shown at B and this while being supported by the rollers 13.

At this stage, the heating head 12 performs its function of printing by throwing heated ink rendered liquid as physically shown by the arrows C.

Once printed and upon moving under its own impetus provided by a lifting depression or partial vacuum produced by the apparatus, the document would move out through the slot 14 for travelling to and reaching underneath the casing 2 forming the heating enclosure.

The printed document shown at D on FIG. 3 thus reaches a first photodetector 6 which at that point causes the rollers 7 to be driven for thereby carrying along the document D to the second photodetector 8 which operates the stop of the motor M driving the rollers 7 and substantially at the same time the lighting or switching on of the halogen lamps 24.

These lamps will therefore for a relatively short time (a few seconds, for example for about 2 to 3 seconds) heat the subjacent document D to a temperature lying between 100° C. and 150° C. and preferably equal to about 130° C., so that the printings on this document will pass through the latter to appear in negative form or as an inverted writing onto the back face, i.e. opposite to the front face which is printed.

Figure 5:
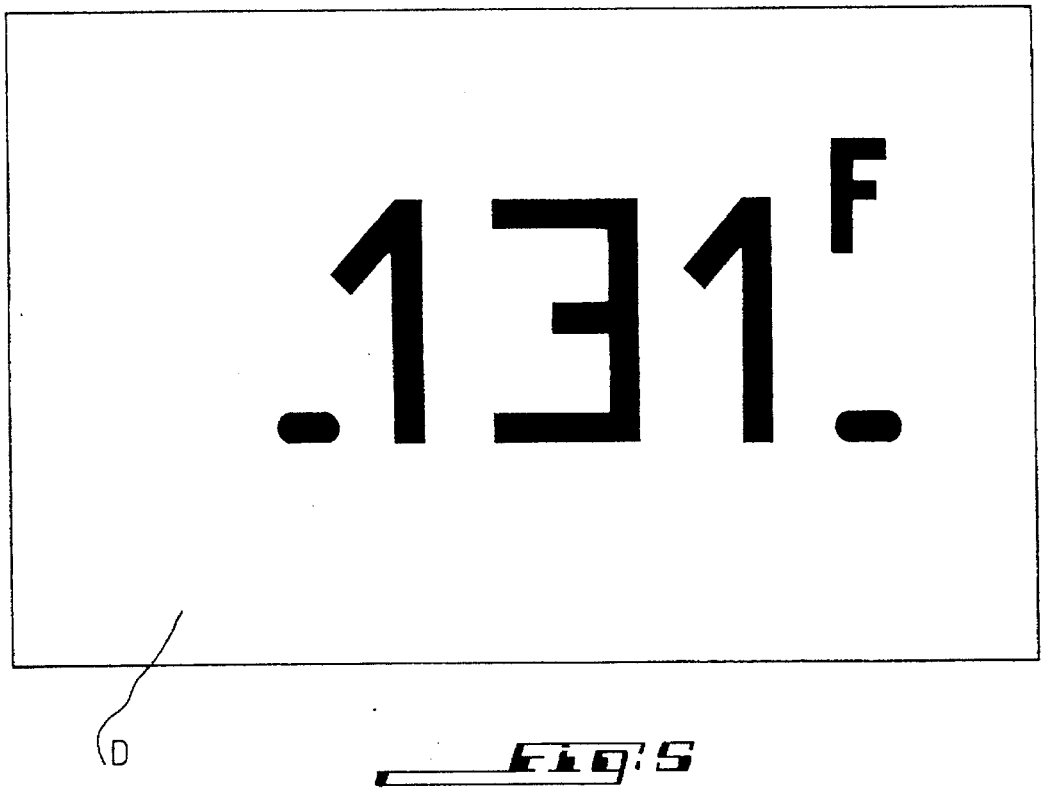
FIG. 5 is a top view of the front face of a printed document obtained with the apparatus.
Figure 6:
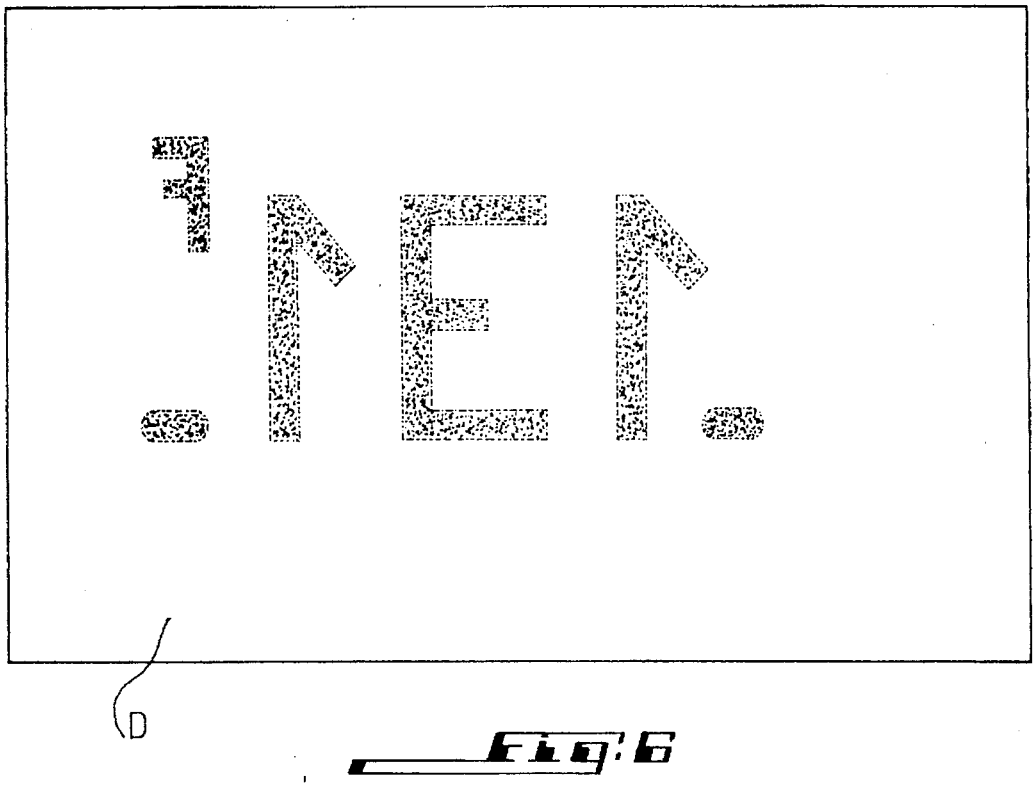
FIG. 6 is a view of the back face of this document.

In other words there occurs an ink transfer through the whole thickness of the document and which causes to appear on the back face a substantially exact replica with inverted writing of the printings as well seen on FIG. 5 illustrating the front face and on FIG. 6 illustrating the back face. This means that the document strictly exhibits the same visual characteristics on its two sides.

After the lapse of the required heating time, the lamps 24 would be switched out and the motor M and the rollers 7 would again drive and carry along the document D to eject it through the slot 15 which therefore will permit to recover a printed document which however has been rendered fully unfalsifiable unless destroying it at least in part owing to the front and back printing carried out on the said document and through the latter.

There has thus been provided according to the invention an improved apparatus making unfalsifiable the documents it prints and which may constitute bank documents in general or also for instance cheque letters, assignment orders, transfer orders, official or administrative documents, identity documents or other important documents.

The invention is of course not at all limited to the embodiment described and illustrated which has been given by way of example only.

Thus the halogen tubes in the casing forming a heating enclosure may be of any nature and in any number. Likewise the system for driving and carrying along documents in this casing may be any device without departing from the scope of the invention.

This means that the invention comprises all the technical equivalents of the means described as well as their combinations if the latter are carried out according to its gist and within the scope of the appended claims.

What is claimed is:

1. An apparatus for printing on a document having first and second faces and for making said document less subject to falsification, said apparatus comprising:

a body which includes:

a printing system using ink for printing on said first face of said document to form a printed document;

means for passing said document past said printing system for printing on said first face by said printing system;

a receptacle in said body for receiving said printed document;

said receptacle having an open cavity, a casing mountable onto said body over said open cavity, said casing comprising means for heating said printed document sufficient to impregnate and to transfer said ink between said first and second faces of said printed document to make appear on said second face a substantially exact but inverted replica of the printing on said first face of said printed document, thus forming a printed document less subject to falsification; and a slot between said body and said casing for discharging said printed document.

2. The apparatus of claim 1 wherein said means for heating comprises at least one halogen tube located plumb with said receptacle and said open cavity.

3. The apparatus of claim 2 wherein said casing further comprises a first photodetector for detecting entry of said printed document from said body into said receptacle, said first photodetector located between said body and said open cavity; and means for driving and carrying said printed document from said body into said open cavity, said means for driving and carrying being activated by said first photodetector upon detecting said printed document.

4. The apparatus of claim 3 wherein said means for driving and carrying further comprising at least one roller.

5. The apparatus of claim 4 further comprising a second photodetector for detecting said printed document at said second photodetector, wherein said second photodetector is located between said open cavity and said slot, wherein said second photodetector deactivates said at least one roller holding said printed document within said open cavity and wherein said second photodetector activates said at least one halogen tube.

6. The apparatus of claim 5 wherein said casing further comprises a cooling fan and a first power connection, said first power connection providing power to said fan, to said at least one halogen tube, to said at least one roller and to said first and second photodetectors.

7. The apparatus of claim 6 wherein said body further comprises a second power connection, wherein said second power connection is connected to said first power connection for providing power thereto.

8. The apparatus of claim 7, wherein said casing further comprises side extensions having an underside, wherein said first power connection is located on said underside, wherein said second power connection is located on said body to coincide with said first power connection when said casing bears down on said receptacle.

9. The apparatus of claim 8 wherein said document is a banking document, and wherein said printing system further comprises a tank for holding said ink and a heating head for liquefying said ink.

10. An apparatus for printing a document having first and second faces and for making same less subject to falsification comprising:

a body member;

means for conveying said document inside said body member;

an ink-jet printing system arranged within said body member to print on said first face of the document as it passes by the printing system;

a slot provided in said body member to discharge the printed document therefrom;

a receptacle provided in said body member for receiving said printed document; and a casing mountable onto said body member at the level of said receptacle, said casing means comprising means for heating said first face of the printed document in order to impregnate and transfer ink throughout the thickness of the printed document to make appear on said second face of the latter a substantially exact but inverted replica of the printing previously made onto the first face of said document.

11. An apparatus according to claim 10, wherein said body member includes a top wall wherein said receptacle is formed, said casing is fitted at least in part into said receptacle, and said slot is provided between said body member and the said casing when said casing is mounted onto said receptacle.

12. An apparatus according to claim 10, wherein the casing includes an opening located plumb with said receptacle and the heating means includes at least one halogen tube capable of transmitting heat through the casing opening to heat the documents.

13. An apparatus according to claim 12, wherein the casing comprises a first photodetector to sense the document entering the receptacle beneath the casing, said first photodetector controlling rollers for driving and carrying the document within the casing.

14. An apparatus according to claim 13, wherein the casing comprises a second photodetector which operates to stop the rollers and turn on said at least one halogen tube when the document assumes a heating position within the casing.

15. An apparatus according to claim 12, wherein the casing further comprises side extensions having mains and wherein the casing is provided with a cooling fan for cooling said heating means, said fan connecting to said mains of said casing bearing upon the body of the apparatus.

16. An apparatus according to claim 12, wherein the document is a banking document and wherein the ink jet printing system includes a tank for a wax-based solid ink with which is associated a heating head to liquefy the ink.

* * * * *